United States Patent [19]

Korshunov et al.

[11] 4,438,802

[45] Mar. 27, 1984

[54] CONTINUOUS CASTING WITHDRAWAL APPARATUS

[76] Inventors: Evgeny A. Korshunov, pereulok Otdelny, 5a, kv. 29, Sverdlovsk; Maxim B. Ovodenko, ulitsa Gorkogo, 19, kv. 5, Krasnoyarsk; Alexandr N. Kuznetsov, prospekt Mira, 118, kv. 49, Krasnoyarsk; Gennady G. Kuzmin, ulitsa Lebedevoi, 147a, kv. 9, Krasnoyarsk; Valery P. Kostrov, ulitsa Bozhova, 57, kv. 10, Sverdlovsk; Alexandr N. Timofeev, ulitsa Kachinskaya, 60a, kv. 3, Krasnoyarsk; Tatyana V. Meschaninova, ulitsa Malysheva, 127a, kv. 21, Sverdlovsk; Valery L. Bastrikov, ulitsa Malysheva, 127a, kv. 21, Sverdlovsk, all of U.S.S.R.

[21] Appl. No.: 322,700

[22] Filed: Nov. 18, 1981

[51] Int. Cl.[3] ..... B22D 11/124; B22D 11/128

[52] U.S. Cl. ..... 164/443; 164/447; 164/440

[58] Field of Search ..... 164/484, 485, 441, 443, 164/440, 447, 490

[56] References Cited

U.S. PATENT DOCUMENTS 4,214,623 7/1980 Jaenson ..... 164/484 X

FOREIGN PATENT DOCUMENTS 1522110 8/1978 United Kingdom .

OTHER PUBLICATIONS

"Horizontal Continuous Casting of Nonferrous Metals and Alloys", Metallurgia Publishers, Moscow, 1974, pp. 27–28 and 31–33.

*Primary Examiner*—Kuang Y. Lin

*Attorney, Agent, or Firm*—Fleit, Jacobson, Cohn & Price

[57] ABSTRACT

An apparatus for withdrawing a metal casting from the mould of a continuous metal casting plant comprises a movable housing and cooled shoes disposed along the perimeter of the casting. Each shoe is provided with two pairs of wedges disposed between the shoe and the housing. One of the wedges of each pair is rigidly secured on the shoe. The other wedges of these pairs are connected with each other through a member adjustable in length and one of them also with a crossbar through a member of a constant length. The apparatus is also provided with a drive for pressing the shoes against the casting and a drive for withdrawing the casting from the mould, rods of hydraulic cylinders thereof being connected to the crossbar. The proposed invention makes it possible to improve the quality of a casting, increase the metal yield and to step up the rate of casting.

2 Claims, 1 Drawing Figure

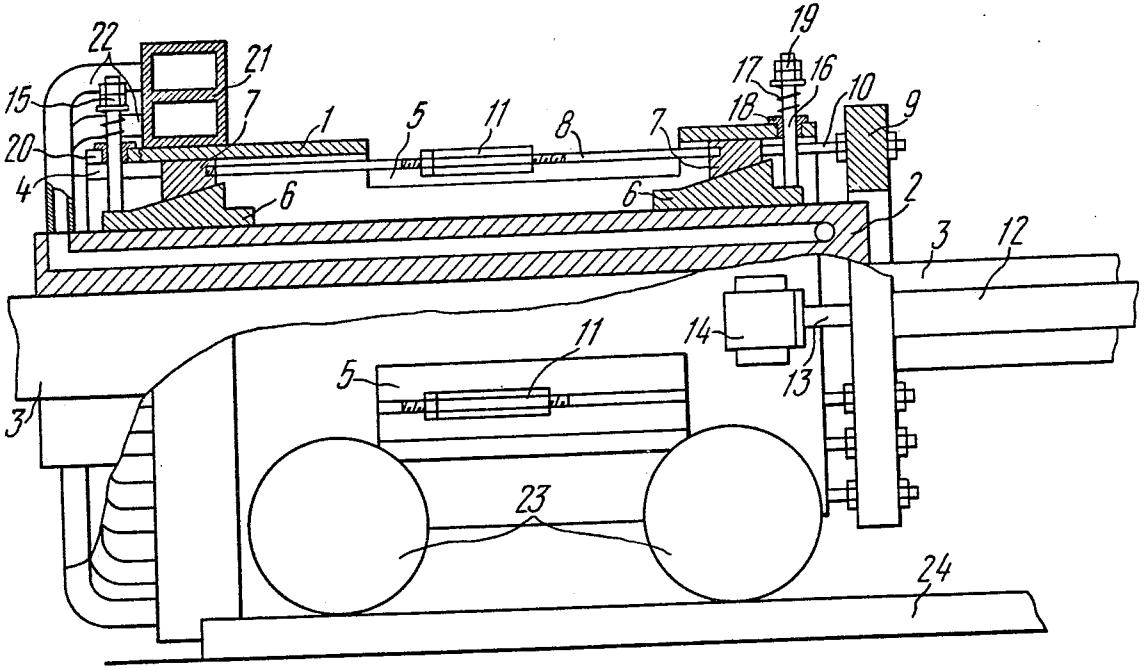
12
3
2
9
10
16
19
17
18
7
6
8
11
5
1
21
7
22
15
20
4
6
11
14
13
5
23
24
3

CONTINUOUS CASTING WITHDRAWAL APPARATUS

FIELD OF THE INVENTION

The present invention relates to metal casting plants and more particularly to apparatus for withdrawing a casting from a mould.

The invention may be used in metallurgy industry in continuous metal casting plants wherein a continuously formed casting is withdrawn from the mould horizontally or at a certain inclination to the horizontal plane.

BACKGROUND OF THE INVENTION

Known to the prior art are apparatus for continuous metal casting (cf, the book "Horizontal Continuous Casting of Nonferrous Metals and Alloys" by Shatagin O. A., Sladkoshteev V. P., et al, Moscow, Publishing House "Metallurgia", 1974, p.p. 27–28, 31–33, in Russian). In continuous metal casting plants castings are withdrawn from the mould with the aid of roller racks or with the aid of shoes pressed against the casting to be withdrawn.

Construction of such apparatus fails to provide a precise control over the process of withdrawing the casting from the mould, i.e., fails to provide a rapid and reliable withdrawal of the casting from the mould.

Known to the prior art is an apparatus (cf. Great Britain Pat. No. 1,522,110, Int. Cl. B 22 d 11/28, 1978) for withdrawing a casting from the mould, comprising a movable housing with movable shoes, each of which is associated with the housing through an intermediate rod. The rod is preloaded by springs and with respect to the housing may move parallel to the axis of the casing. For adjusting the force of the springs, provision is made for a ring. When the apparatus housing is moved in the direction of movement of the casting the housing causes wedges secured in the housing to jam rollers. As a result, the rollers press the shoes against the casting and the latter is gripped thereby. When the housing is moved in the reverse direction the rollers are released under the action of the springs and the shoes are free to return to the initial position. Thereafter the apparatus is ready to repeat the cycle of step-by-step withdrawal of the casting.

Construction of the apparatus provides only a small contacting area between the shoes and the casting, has a complicated kinematics of the shoes, fails to ensure a precise control over the casing withdrawal process and also to combine the performance of two functions: withdrawal and intensive cooling of the casting.

SUMMARY OF THE INVENTION

It is an object of the present invention to provide an apparatus for withdrawing a casting from a mould, ensuring a rapid and reliable withdrawal of the casting from the mould.

It is another object of the invention to provide an intensive cooling of the casting in the zone of secondary cooling.

These and other objects of the invention are accomplished by that in an apparatus for withdrawing a casting from the mould of a contunous metal casting plant, comprising a movable housing, cooled shoes disposed along the perimeter of the casting, a drive for pressing the shoes against the casting, a drive for withdrawing the casting from the mould according to the invention, each cooled shoe is provided with two pairs of wedges disposed between the shoe and the housing, one of the wedges of each pair being rigidly secured on the shoe and the other wedges of each pair being connected with each other through a member adjustable in length one of them also with a crossbar through a member of a constant length, while the crossbar is connected with rods of hydraulic cylinders of the drive for withdrawing the casting from the mould and with rods of hydraulic cylinders of the drive for pressing the shoes against the casting.

The apparatus may suitably be provided with mechanisms for moving the cooled shoes in the direction perpendicular to the direction of movement of the casting member of which corresponds to the number of pairs of the wedges each of which comprises a rod having a spring and installed on the wedge rigidly secured on the shoe, and a bushing accommodating the rod adapted to be moved in the direction perpendicular to the direction of movement of the casting.

BRIEF DESCRIPTION OF DRAWING

The invention will now be described in detail with reference to the accompanying drawing illustrating a general view of an apparatus for withdrawing a casting from the mould of a continuous metal casting plant, according to the invention.

DETAILED DESCRIPTION OF THE INVENTION

An apparatus for withdrawing a casting from a mould during the continuous casting of metals comprises a movable housing 1, cooled shoes 2 encompassing almost the entire surface (approximately 95%) of a casting 3 along the perimeter thereof. The length of the shoe 2 corresponds to or may exceed the length of the withdrawal step of the casting 3. The cooled shoes 2 are internally disposed in the housing 1 made in the form of a tube and provided with recesses 4 and openings 5. Each shoe 2 is provided with two pairs of wedges 6, 7 contacting each other. Each of the wedges 6 of each pair is stationary and is rigidly secured on the shoe 2, while the other, movable wedges 7, are disposed in the recesses 4 of the housing 1 and may be moved in the recesses 4 relative to the housing 1 and the stationary wedges 6.

The movable wedges 7 are connected with each other through a member 8 adjustable in length and one of them also with a movable crossbar 9 through a member 10 of a constant length.

The member 8 is adjusted in length through the openings 5 of the housing 1, with the aid of a sleeve 11 operating on the screw-and-nut principle. Each opening 5 in the housing 1 is made opposite the sleeve 11.

The crossbar 9 is connected to rods 12 of power hydraulic cylinders of a drive for withdrawing the casting 3 from the mould (the hydraulic cylinders and the mould are not shown in the drawing) and to rods 13 of a hydraulic drive 14 for pressing the shoes 2 against the casting 3.

Relative to the end face of the housing 1, the crossbar 9 is installed at a distance being not less than the maximum possible travel of the movable wedges 7 in relation to the stationary wedges 6. The travel of the wedges 7 corresponds to the travel of the rods 13 of the hydraulic drive 14. The hydraulic drives 14 are secured on the housing 1 of the apparatus.

The shoes 2 are kept constantly pressed against the housing 1 through the pairs of the wedges 6 and 7 by means of a mechanism 15 for moving the cooled shoes 2 in the direction perpendicular to the direction of movement of the casting 3.

The mechanism 15 for moving the cooled shoes 2 is made in the form of a rod 16 having a spring 17 and installed on the stationary wedge 6 and in a guide bushing 18 in which the rod 16 is moved in the direction perpendicular to the direction of movement of the casting 3. For adjusting the force of the springs 17, provision is made for a nut 19.

The bushings 18 are arranged in the housing 1 in circular openings on the side of the crossbar 9, while at the opposite end of the housing 1 they are arranged in recesses 20 so as not to disturb the alignment of the housing 1 and the shoes 2 with the casting 3 at the moment when heating or cooling of the shoes 2 takes place, as at this moment the linear dimensions of the shoes 2 are changing.

The number of the mechanisms 15 equals the number of pairs of the wedges 6 and 7.

Mounted on the end of the housing 1, opposite to the crossbar 9, is a two-chamber manifold 21 provided with a system of pipelines 22 for delivering the coolant to and discharging it from each shoe 2.

The housing 1 of the apparatus is installed on rollers 23 and when the casting 3 is being withdrawn, the housing is moved along guides 24.

The apparatus for withdrawing the casting 3 from the mould during the continuous casting of metal operates in the following way.

The shoes 2 are kept constantly pressed against the housing 1 through the pairs of the wedges 6 and 7 by means of the mechanisms 15 for moving the cooled shoes 2 in the direction perpendicular to the direction of movement of the casting 3. The pressure exerted on the shoes 2 is accomplished by the rods 16 preloaded by the springs 17.

First to be cut into operation is the cooling system of the shoes 2 together with the manifold 21 and the system of the pipelines 22. Then follows the preliminary clamping of the casting 3.

When the drives 14 are actuated, their rods 13 connected with the crossbar 9 put the crossbar 9 in motion. Overcoming the force of the springs 17 of the mechanism 15 for moving the cooled shoes 2, the crossbar 9 acting through the members 8 and 10 moves the wedges 7 relative to the wedges 6 for a preset step sufficient for pressing the shoes 2 to the casting 3; as a result, the shoes 2 tightly clamp the casting 3 with a uniform pressure exerted along the entire length due to the uniform movement of the wedges 7 over the wedges 6.

Then the hydraulic cylinders of the drive for withdrawing the casting 3 from the mould are cut into operation and acting through the rods 12, 13 thereof and the movable crossbar 9 withdraw the casting 3 from the mould for the preset length while the cooled shoes 2 provide an additional cooling of the casting.

The withdrawal apparatus is returned to the initial position by reversing the hydraulic cylinders of the drive for withdrawing the casting 3, the shoes 2 being preliminarily unclamped by the hydraulic drives 14 acting through the crossbar 9, the members 8 and 10, and the wedges 6 and 7.

Then the cycle is repeated.

Duration of the pause between the cycles of withdrawing the casting 3 depends on the time of forming the casting 3 in the mould.

If it is required to provide an intensive cooling of the casting 3, the shoes 2 are brought in contact with the casting 3 immediately after the apparatus has been returned to the initial position.

Due to the changed kinematics of the shoes 2, the proposed invention makes it possible to eliminate any damage to the surface of the casting 3 when the latter is withdrawn from the mould and during the idle movement of the apparatus to the initial position.

Due to a clearly defined division of the functions relating to clamping and withdrawing between the two drives, the invention guarantees the withdrawal of the casting 3 for a preset withdrawal step without any slip of the shoes 2 relative to the casting 3. Besides, in pauses between the cycles of withdrawing the casting 3 from the mould, the drive for withdrawing the casting 3 is used for performing additional operations, for example, for pressing the face portion of the skin of the casting 3 being formed in the mould to a member for providing an additional removal of heat from this face surface which further will contribute to a decrease in the force exerted for dividing the casting 3 into cut-to-length sections.

The reliable regulation of pressing the shoes 2 against the casting 3 effected with the aid of the mechanisms 15 for moving the shoes 2 in the direction perpendicular to the direction of movement of the casting 3 and owing to the pairs of the wedges 6 and 7 provides the uniform removal of heat and uniform growth of the skin along the entire perimeter of the casting 3 which eliminates distortion of the geometry of the casting 3 and improves the quality thereof.

The proposed invention allows the method of a horizontal continuous casting of the castings 3, for example, from aluminium alloys, to be effected, thereby making it possible to improve the quality of the castings 3, increase the metal yield by 3–5% and also to step up the rate of casting by 3 to 6 times (depending upon the cross-section area of a casting).

What is claimed is:

1. An apparatus for withdrawing a casting from a mould of a continuous metal casting plant, comprising:

(a) a movable housing;

(b) cooled shoes disposed along the perimeter of said casting and located within said housing;

(c) two pairs of wedges disposed between each said shoe and said housing; one wedge of each of said pair of wedges being rigidly secured on said shoe; the other wedge of said pair being disposed in a recess in said housing for movement relative to said housing and said one wedge;

(d) a member adjustable in length connecting the other wedges of each of said two pairs of wedges with each other;

(e) means for withdrawing said casting from said mould, said withdrawing means including hydraulic cylinders with rods for withdrawing said casting from said mould;

(f) means for pressing said shoes against said casting, said pressing means including hydraulic cylinders with rods for pressing said shoes against said casting;

(g) a crossbar connected with said rods of said means for withdrawing said casting from said mould and said means for pressing said shoes against said casting; and (h) a member of a constant length connecting said other wedges with said crossbar.

2. An apparatus for withdrawing a casting from a mould of a continuous metal casting plant according to claim 1, said apparatus comprising:

(a) mechanisms for moving said cooled shoes in the direction perpendicular to the direction of movement of said casting, the number of said mechanisms corresponding to the number of pairs of wedges;

(b) a rod with a spring on each said mechanism for moving said cooled shoes and installed on said one wedge of said pair of wedges, said one wedge rigidly secured on said shoe; and (c) a bushing to receive each said mechanism for moving said cooled shoesand accommodating said rod adapted to be moved in the direction perpendicular to the direction of movement of said casting.

* * * * *